US007686300B2

(12) United States Patent
Watanabe et al.

(10) Patent No.: US 7,686,300 B2
(45) Date of Patent: Mar. 30, 2010

(54) DRIVING DEVICE

(75) Inventors: Naoto Watanabe, Abiko (JP); Takayuki Fujii, Tokyo (JP); Shunsuke Nishimura, Toride (JP); Toshiyuki Miyake, Toride (JP); Takashi Yokoya, Kashiwa (JP); Ichiro Sasaki, Toride (JP); Akinobu Nishikata, Abiko (JP); Hiroshi Matsumoto, Toride (JP); Mitsuhiko Sato, Kashiwa (JP); Akihiko Sakai, Abiko (JP)

(73) Assignee: Canon Kabushiki Kaisha (JP)

( * ) Notice: Subject to any disclaimer, the term of this patent is extended or adjusted under 35 U.S.C. 154(b) by 137 days.

(21) Appl. No.: 11/860,907

(22) Filed: Sep. 25, 2007

(65) Prior Publication Data

US 2008/0073824 A1 Mar. 27, 2008

(30) Foreign Application Priority Data

Sep. 27, 2006 (JP) ..... 2006-262718
Aug. 7, 2007 (JP) ..... 2007-205406

(51) Int. Cl.
*B65H 9/16* (2006.01)

(52) U.S. Cl. ..... 271/251; 271/274; 271/228

(58) Field of Classification Search ..... 271/251, 271/228, 273, 274, 239, 240
See application file for complete search history.

(56) References Cited

U.S. PATENT DOCUMENTS

| | | | | |
|---|---|---|---|---|
| 6,173,952 | B1 * | 1/2001 | Richards et al. | 271/228 |
| 2005/0035539 | A1 * | 2/2005 | Hashimoto | 271/265.01 |
| 2006/0070840 | A1 * | 4/2006 | Hayashi et al. | 194/206 |
| 2007/0023995 | A1 * | 2/2007 | Onodera | 271/226 |

FOREIGN PATENT DOCUMENTS

| | | | |
|---|---|---|---|
| JP | 62-153033 | A | 7/1987 |
| JP | 7-9852 | U | 2/1995 |
| JP | 2002-193537 | A | 7/2000 |

* cited by examiner

*Primary Examiner*—Patrick H Mackey
*Assistant Examiner*—Ernesto Suarez
(74) *Attorney, Agent, or Firm*—Rossi, Kimms & McDowell LLP

(57) ABSTRACT

A sheet processing apparatus is disclosed which is capable of preventing a motor from losing synchronization when initializing a roller position at power-up time, even if a diagonal feed mechanism does not have a sensor for detecting a position of a diagonal feed roller pair.

3 Claims, 10 Drawing Sheets

DRIVING DEVICE

BACKGROUND OF THE INVENTION

1. Field of the Invention

The present invention relates to a driving device for, for example, a sheet processing apparatus for diagonally feeding and shift-loading a sheet to be carried in either of the sheet width directions.

2. Description of the Related Art

As a finishing process apparatus connected to a copy machine or other image forming apparatus, a sheet processing apparatus has been proposed (Japanese Patent Laid-Open No. 2002-193537) in which, a sheet being carried by a diagonal feed mechanism disposed along a sheet carrying path is diagonally fed towards the front (near side) of the apparatus or towards the rear (back side) of the apparatus, that is, in the sheet width direction intersecting the sheet carrying direction at a right angle, and is shift-loaded (shifted and loaded) according to the width of the sheet.

This diagonal feed mechanism comprises two diagonal feed roller pairs positioned separated from each other in the sheet width direction intersecting with the carrying direction of the sheet at a right angle. The two diagonal feed roller pairs are positioned diagonally such that the respective axes thereof intersect downstream along the sheet carrying direction.

Depending on the shift direction of the sheet, rollers of one of the diagonal feed roller pairs are caused to close and sandwich and carry the sheet while rollers of the other diagonal feed roller pair are caused to open, thus diagonally feeding the sheet towards the front or towards the rear of the apparatus. The action of the rollers of the two diagonal feed roller pairs closing and opening is controlled by a driving unit (such as a pulse motor, etc.).

Incidentally, when powering up, the positions of the rollers in the direction of closing and opening of the diagonal feed roller pairs is undetermined. For this reason, in order to determine accurately the initial position of the diagonal feed rollers, generally the diagonal feed rollers provided with a detection flag are moved and the position of the diagonal feed rollers is detected by sensors, the initial position of the diagonal feed rollers thus being determined accurately based on these detection results.

However, in this case position sensors must be provided for each of the two diagonal feed roller pairs, incurring a cost.

Accordingly, in Japanese Patent Laid-Open No. 2002-193537 mentioned above, an abutting member is provided to the diagonal feed roller that is movable, and this diagonal feed roller is moved during initialization towards a positioning member which is immovably fixed, and the abutting member abuts the positioning member, thus determining the initial position of the diagonal feed rollers. It is thus possible to determine accurately the initial position of the diagonal feed rollers without using position sensors, making it possible to cut costs.

However, with the above prior art, if the abutting member of the diagonal feed roller is already abutting the positioning member when powering up, a motor is driven so as to move the movable diagonal feed roller towards the positioning member with the abutting member already abutting the positioning member. This causes the problems of the motor losing synchronization, a reduction in quietness, and a reduction in the durability of the diagonal feed mechanism due to a large load.

SUMMARY OF THE INVENTION

The present invention allows realization of a driving device to determine accurately an initial position of a movable body by controlling loss of synchronization of a driving unit when initializing a position of a movable body when powering up, even for driving mechanisms which do not have sensors for detecting the position of the movable body.

According to the present invention, the foregoing problem is solved by providing a driving device, comprising:

a driving unit adapted to move a movable body, an abutting member adapted to be abutted by the movable body, a control unit adapted to perform control such that an initial position of the movable body is determined by causing the movable body to abut the abutting member using the driving unit at the time of driving unit power-up, and the movable body is separated from the abutting member when the driving unit is stopped.

Further features of the present invention will be apparent from the following description of exemplary embodiments with reference to the attached drawings.

DESCRIPTION OF THE EMBODIMENTS

A preferred embodiment of the present invention will now be described in detail with reference to the drawings. It should be noted that the relative arrangement of the components, the numerical expressions and numerical values set forth in these embodiments do not limit the scope of the present invention unless it is specifically stated otherwise.

Figure 1:
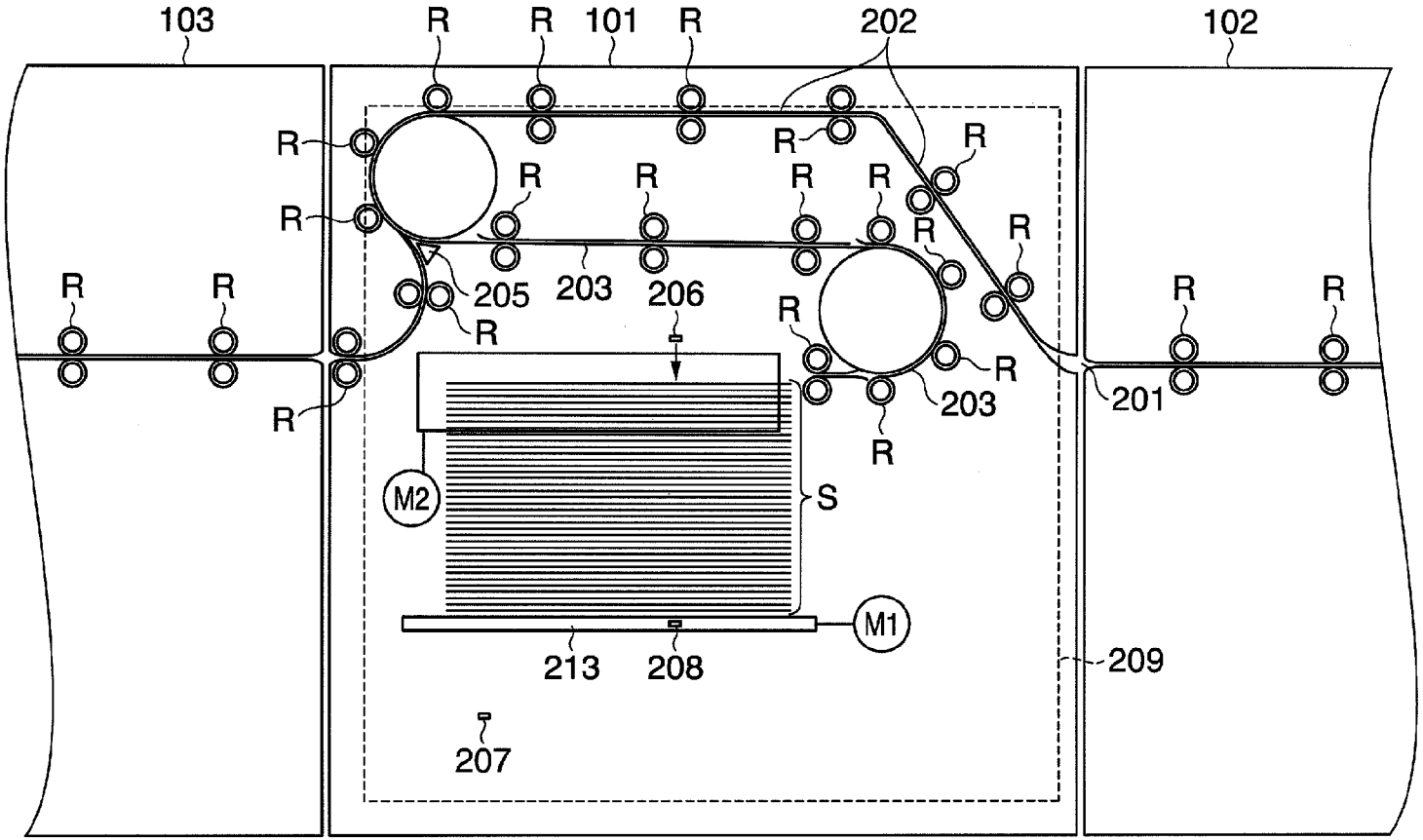
FIG. 1 is a schematic cross-sectional view for describing a sheet processing apparatus which is one example of an embodiment of the present invention.
Figure 2:
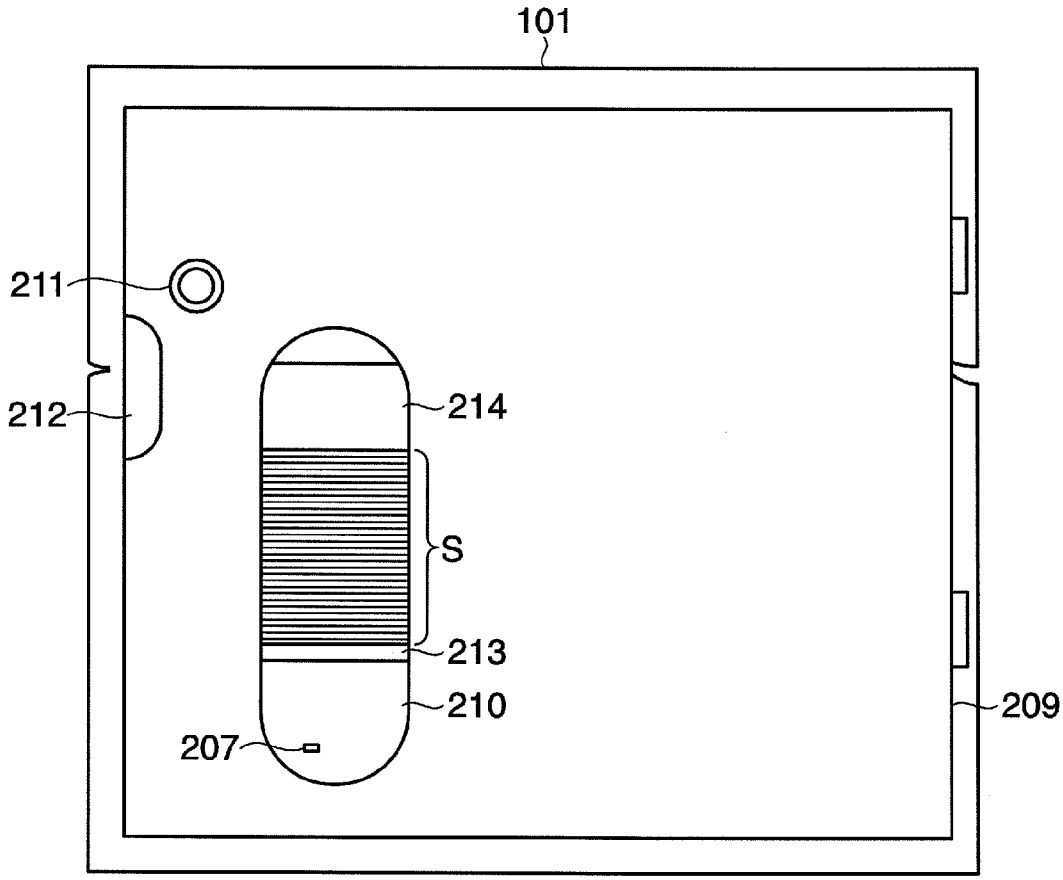
FIG. 2 is an exterior view seen from the front of the sheet processing apparatus shown in FIG. 1.
Figure 3:
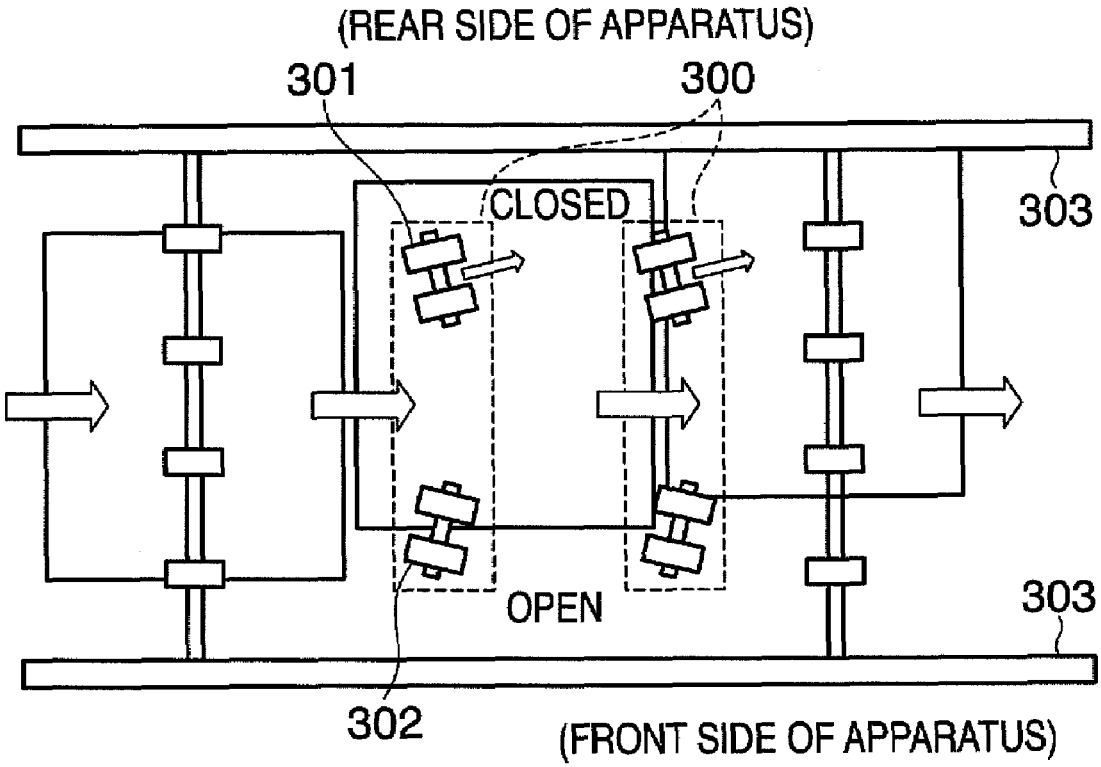
FIG. 3 is a view for describing a diagonal feed action of a sheet by a diagonal feed mechanism.
Figure 4A:
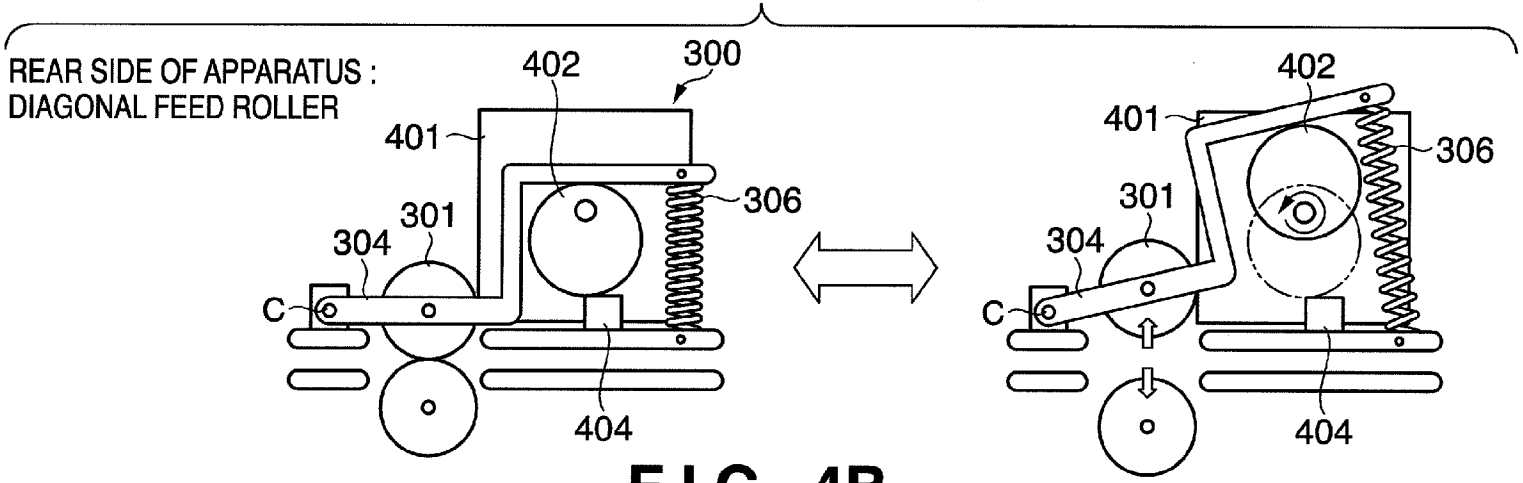
FIG. 4A is a view showing the diagonal feed mechanism in the rear of the apparatus, for describing the action of closing and opening of a diagonal feed roller pair of the diagonal feed mechanism.
Figure 4B:
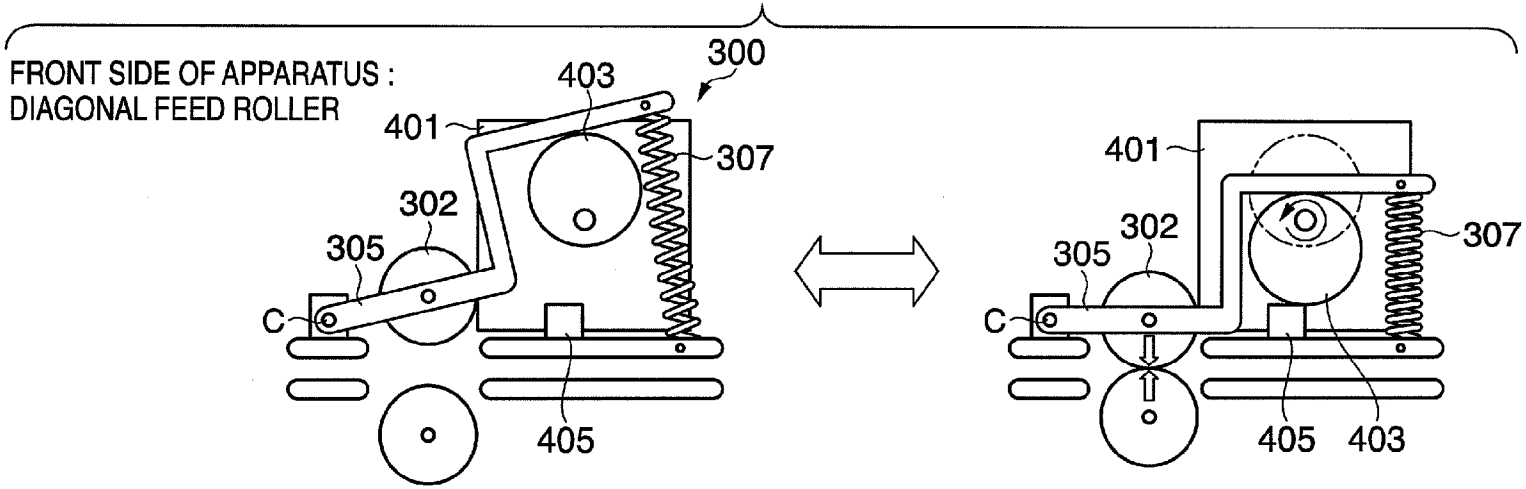
FIG. 4B is a view showing the diagonal feed mechanism in the front of the apparatus.
Figure 5:
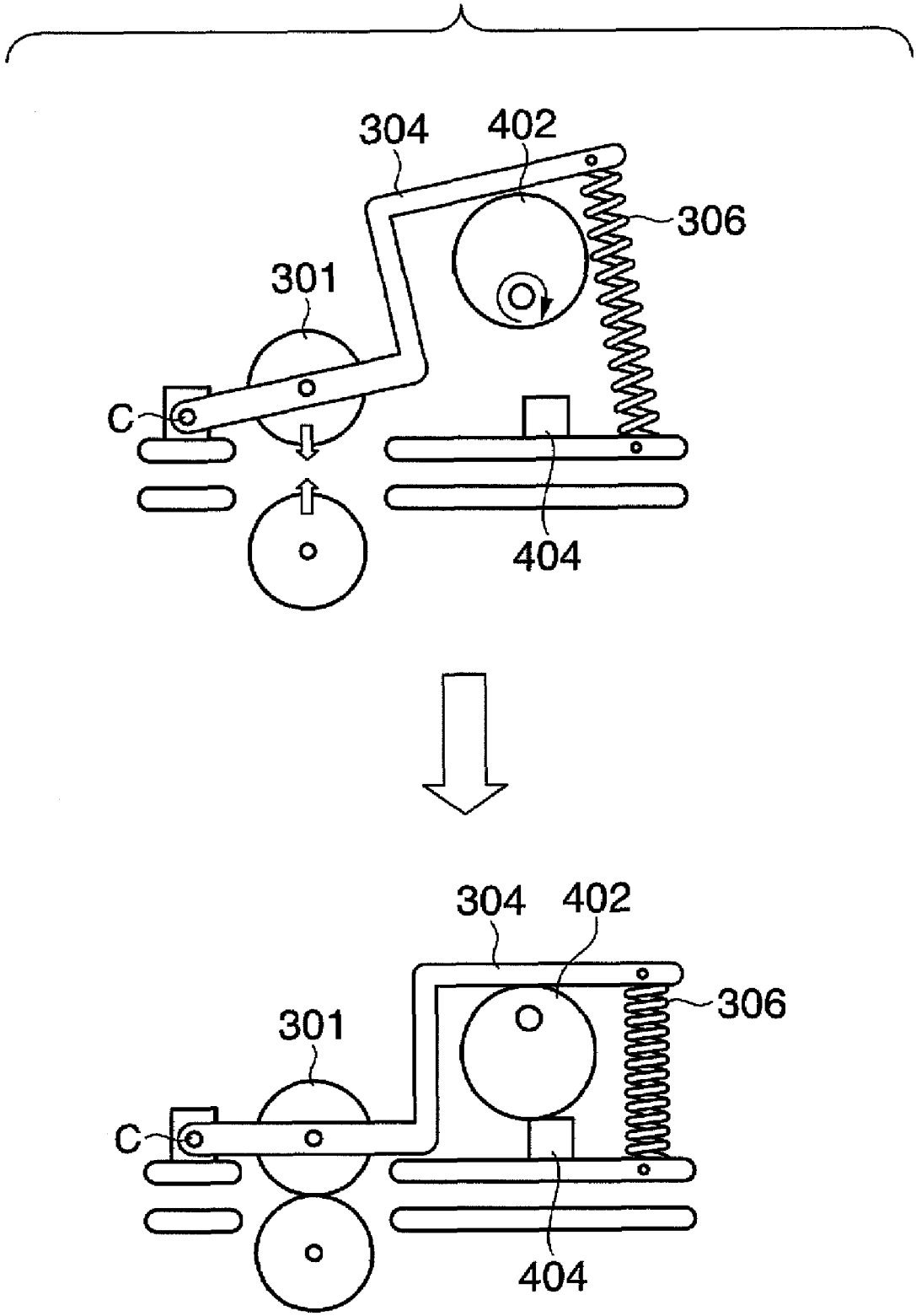
FIG. 5 is a view for describing initialization of the diagonal feed mechanism.
Figure 6:
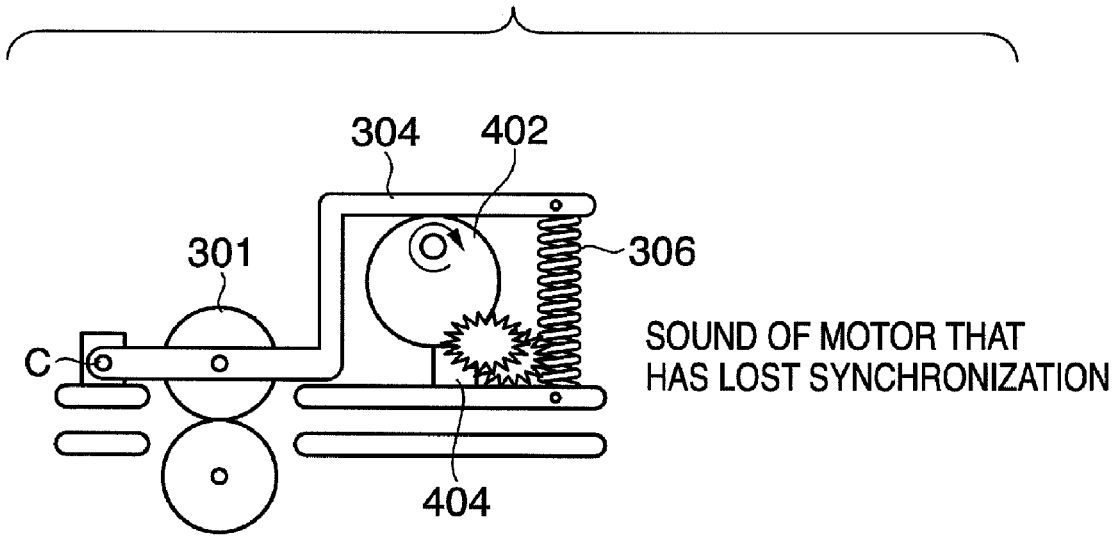
FIG. 6 is a view for describing problems with initialization in conventional diagonal feed mechanisms.
Figure 7:
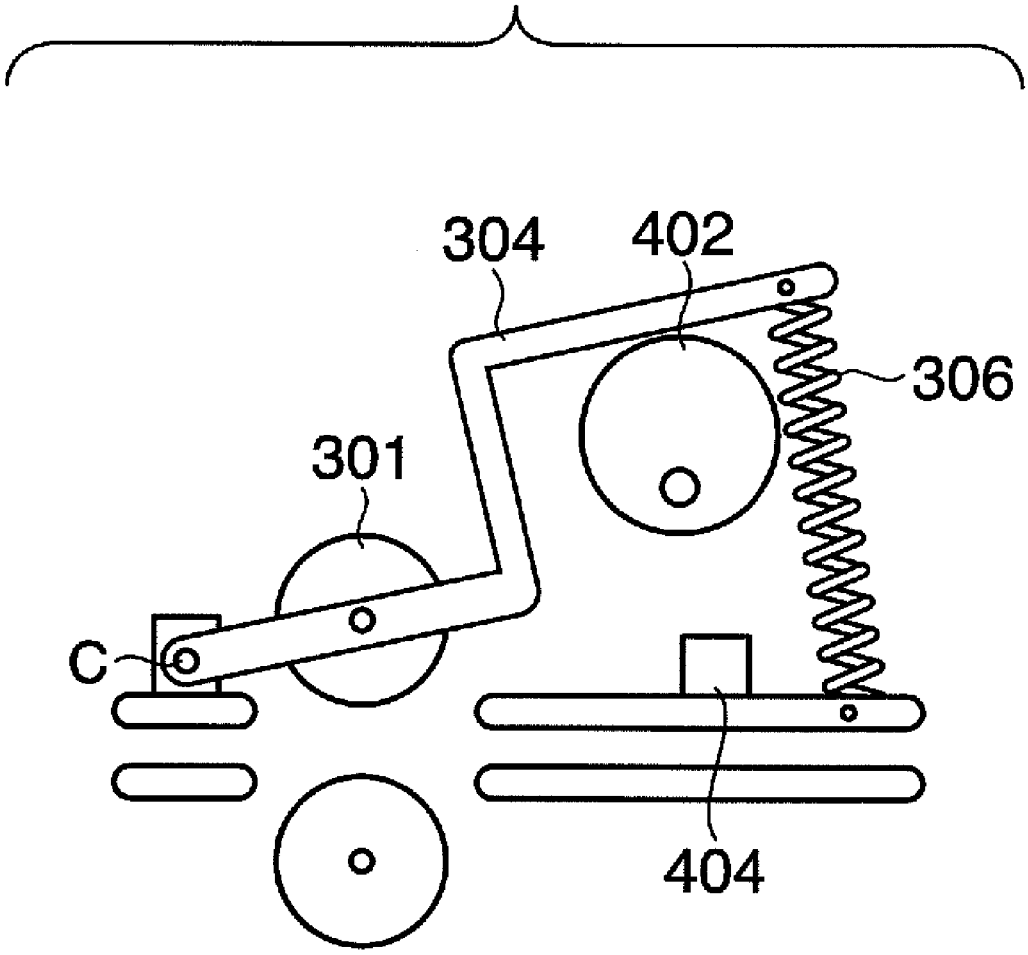
FIG. 7 is a view for describing stopped position control of the diagonal feed mechanism.
Figure 8A:
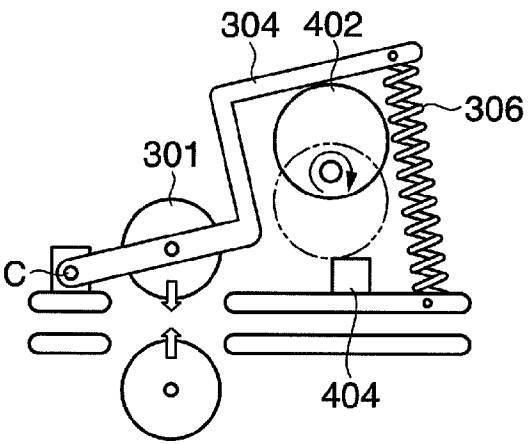
FIG. 8A is a view showing an abutting member in a separated state.
Figure 8B:
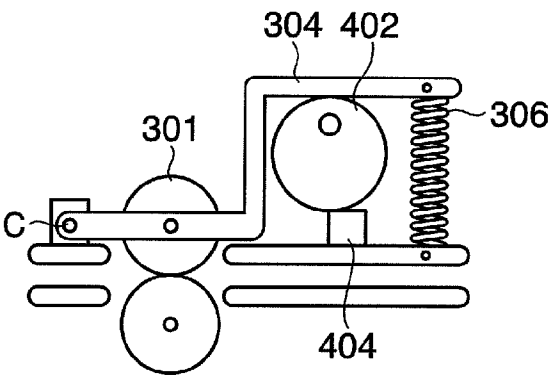
FIG. 8B is a view showing the abutting member in an abutted state.
Figure 8C:
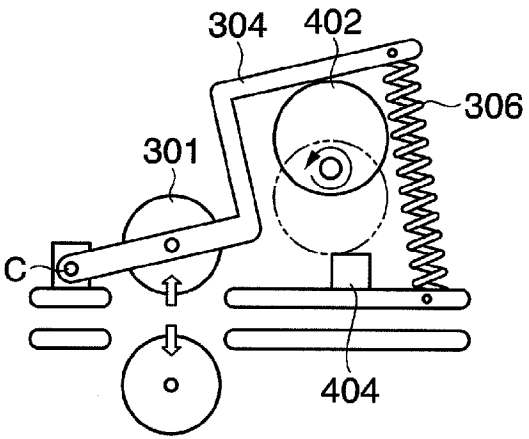
FIG. 8C is a view showing the abutting member in a separated state.
Figure 9:
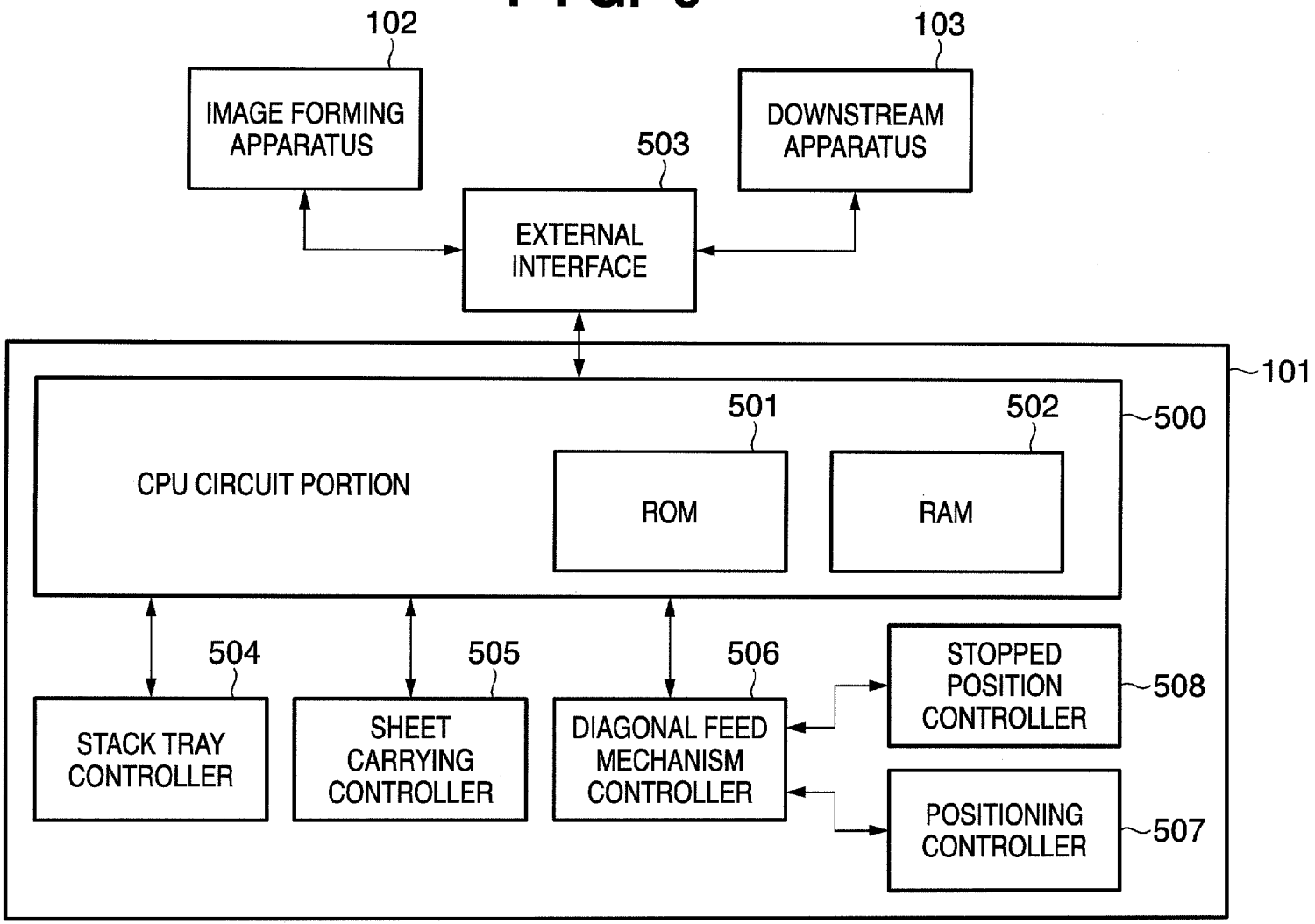
FIG. 9 is a control block diagram of the sheet processing apparatus which is one example of an embodiment of the present invention.
Figure 10:
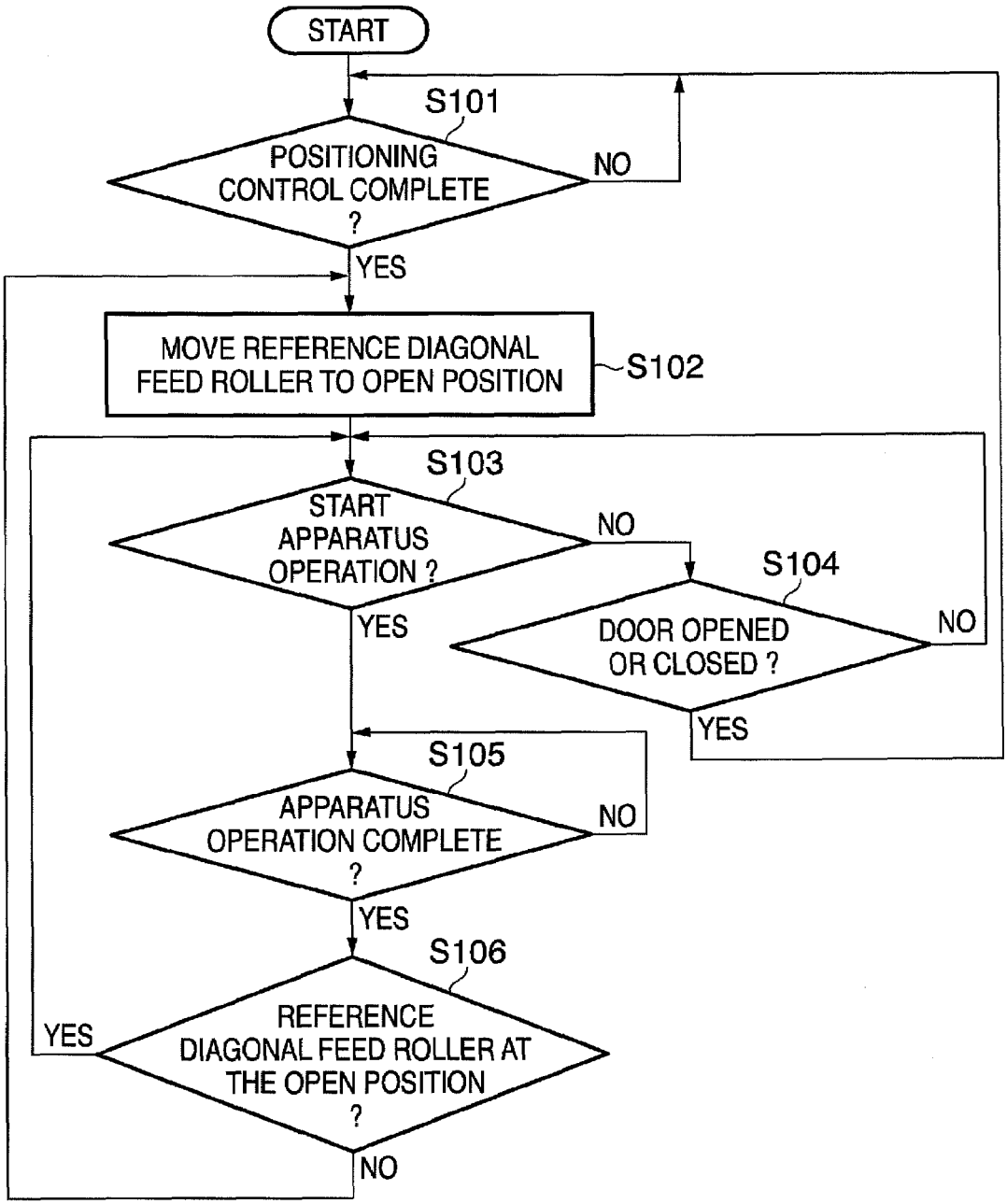
FIG. 10 is a flow chart for describing stopped position control of the diagonal feed mechanism.

FIG. 1 is a schematic cross-sectional view for describing a sheet processing apparatus which is one example of an embodiment of a driving device according to the present invention, FIG. 2 is an exterior view seen from the front of the sheet processing apparatus shown in FIG. 1, and FIG. 3 is a view for describing a diagonal feed action of a sheet by a diagonal feed mechanism. FIGS. 4A and 4B are views for describing the action of closing and opening of a diagonal feed roller pair of the diagonal feed mechanism, FIG. 5 is a view for describing initialization of the diagonal feed mechanism, FIG. 6 is a view for describing problems with initialization in conventional diagonal feed mechanisms, and FIG. 7 is a view for describing stopped position control of the diagonal feed mechanism. FIGS. 8A to 8C are views for describing initialization of the diagonal feed mechanism, FIG. 9 is a control block diagram of the sheet processing apparatus which is one example of an embodiment of the present invention, and FIG. 10 is a flow chart for describing stopped position control of the diagonal feed mechanism.

FIG. 1 is an illustrative schematic cross-sectional view of a sheet processing apparatus according to an embodiment. An image forming apparatus 102 is connected upstream of a sheet processing apparatus 101 of this example, and a downstream apparatus 103 is connected downstream. Examples of the downstream apparatus 103 include a binding machine, a finisher, and other sheet processing apparatuses. Moreover, other sheet processing apparatuses may be connected between the sheet processing apparatus 101 and the image forming apparatus 102 as separate finishing process apparatuses.

The sheet processing apparatus 101 is provided with a stack tray 213 for sequentially accepting into the apparatus and loading a plurality of sheets S ejected from the image forming apparatus 102.

The stack tray 213 is raised and lowered by a driving motor M1. A sheet regulating member 214 is provided above the stack tray 213.

The sheet regulating member 214 can be shifted in the sheet width direction according to the sheet width by a driving motor M2 in order to improve loading of the sheets S on the stack tray 213. Specifically, when a sheet S is ejected from the image forming apparatus 102, information regarding the sheet width of the ejected sheet S is sent from the image forming apparatus 102 to the sheet processing apparatus 101. The driving motor M2 is controlled based on this sheet width information, and the sheet regulating member 214 is shifted to a position matching the sheet width.

A sheet entry hole 201 for taking in the sheets S ejected from the image forming apparatus is provided to a side portion of the sheet processing apparatus 101 facing the image forming apparatus 102. The sheets S taken in by the sheet entry hole 201 are carried along a carrying path 202 to a position where a sheet stacking carrying path 203 and an ejection carrying path 204 split. Moreover, the symbol "R" in FIG. 1 indicates carrying rollers for carrying the sheets S along the carrying paths 202, 203, and 204.

The sheet stacking carrying path 203 is used when loading the sheets S on the stack tray 213 in the sheet processing apparatus 101, and along it is positioned a diagonal feed mechanism 300 (see FIG. 3), described below. This diagonal feed mechanism 300 makes it possible to shift-load loaded sheaves of sheets onto the stack tray 213. The ejection carrying path 204 is used when ejecting the sheets S towards the downstream apparatus 103 without loading them onto the stack tray 213 in the sheet processing apparatus 101.

A switching flapper 205 for switching the carrying route of the sheets S between the sheet stacking carrying path 203 and the ejection carrying path 204 is positioned at the point where the sheet stacking carrying path 203 and the ejection carrying path 204 split. The switching flapper 205 switches the carrying route of the sheets S to the sheet stacking carrying path 203 when guiding the sheets S towards the stack tray 213 in the sheet processing apparatus 101. The switching flapper 205 switches the carrying route of the sheets S to the ejection carrying path 204 when ejecting the sheets S towards the downstream apparatus 103.

The sheet processing apparatus 101 is provided with a sensor 206 for detecting a top surface of the loaded sheets S when sequentially loading the sheets S onto the stack tray 213. Based on the detection results of the sensor 206, the driving motor M1 is controlled such that the stack tray 213 is raised and lowered to a sheet receiving position.

The sheet processing apparatus 101 is further provided with a sensor 207 for detecting the bottom limit position of the stack tray 213 and a sensor 208 for detecting whether or not a sheet S is loaded onto the stack tray 213. When lowering the stack tray 213 to the sheet removing position, the driving motor M1 lowers the stack tray 213 until detected by the sensor 207.

FIG. 2 is an exterior view seen from the front of the sheet processing apparatus according to an embodiment.

As shown in FIGS. 1 and 2, a door 209 is provided to the front side of the sheet processing apparatus 101. The door 209 is closed so that a user cannot directly touch a driving portion or the sheets S when loading sheets to the stack tray 213. In this closed state, the door 209 is locked by a door locking mechanism (not shown) to prevent accidental opening.

As shown in FIG. 2, the door 209 is provided with a door open button 211 for unlocking the door 209, and a window 210 for checking the loaded state of the sheets S loaded on the stack tray 213. Pressing the door open button 211 unlocks the door 209 and allows the user to open the door 209 by holding a handle 212, for example. Thus, the interior of the apparatus can be accessed by opening the door 209 when removing the sheets S or fixing a paper jam.

FIG. 3 is a view for describing a diagonal feed action of a sheet by the diagonal feed mechanism.

As shown in FIG. 3, a plurality of diagonal feed mechanisms (driving mechanisms) 300 are disposed at prescribed intervals along the sheet carrying direction of the sheet stacking carrying path 203.

The diagonal feed mechanisms 300 are provided with two diagonal feed roller pairs (movable bodies) 301 and 302 positioned separated from each other to the front and back of the apparatus 101 (the sheet width direction which intersects the carrying direction of the sheet S at a right angle), and a strike guide 303 which moves in the width direction of the sheet S according to the width dimension of the sheet S. The two diagonal feed roller pairs 301 and 302 are disposed diagonally such that the respective axes thereof intersect downstream along the sheet carrying direction.

When shifting the sheet S toward the rear (indicating the rear side of the apparatus in FIG. 3) of the apparatus 101, the rollers of the rear-side diagonal feed roller pair 301 close and the sheet S is sandwiched and carried (diagonally fed), and the rollers of the diagonal feed roller pair 302 on the front side (indicating the front side of the apparatus in FIG. 3) open. When shifting the sheet S toward the front of the apparatus 101, the rollers of the front-side diagonal feed roller pair 302 close and the sheet S is sandwiched and carried (diagonally fed), and the rollers of the rear-side diagonal feed roller pair 301 open.

The sheet S is thus shift-loaded onto the stack tray 213 via the sheet stacking carrying path 203 after the sheet S is diagonally fed to the front or the back of the apparatus 101, strikes the strike guide 303, and the determined shift amount is assured.

As shown in FIGS. 4A and 4B, the axes of the rollers of the diagonal feed roller pairs 301 and 302 are rotatably supported by cam latching members 304 and 305 rotatable in the thickness direction of the carried sheet S (the closing/opening direction of the rollers) around a support point C. For purposes of this explanation, in FIGS. 4A and 4B, the cam latching members 304 and 305 are only provided to the upper rollers of the diagonal feed roller pairs 301 and 302, although the cam latching members 304 and 305 are similarly provided to the lower rollers of the diagonal feed roller pairs 301 and 302. The cam latching members 304 and 305 are biased to approach the rollers of the diagonal feed roller pairs 301 and 302 by coil springs 306 and 307.

Eccentric cams (abutting members) 402 and 403 attached to a shaft of a two-shaft stepper motor (hereafter called a two-shaft motor) 401 as a driving unit cam-engage the cam latching members 304 and 305. The eccentric cam 402 and the eccentric cam 403 are attached to the shafts of the two-shaft motor 401 so as to have phases which are 180° apart.

As the two-shaft motor 401 rotates, the cam latching members 304 and 305 rotate around the support point C in conjunction with the action of the eccentric cams 402 and 403, and the rollers of the diagonal feed roller pairs 301 and 302 perform the actions of, respectively, closing and opening at the same time.

Since the phases of the eccentric cams 402 and 403 are 180° apart, the rollers of the diagonal feed roller pair 302 open (left side of FIG. 4B) and stop at a second stopped position when the rollers of the diagonal feed roller pair 301 is at a first stopped position closing (left side of FIG. 4A) and sandwiching and carrying (diagonally feeding) the sheet S.

When the rollers of the diagonal feed roller pair 301 open (right side of FIG. 4A) and are at the second stopped position, the rollers of the diagonal feed roller pair 302 are at the first stopped position, where they close (right side of FIG. 4B), and sandwich and carry (diagonally feed) the sheet S.

When the rollers of the diagonal feed roller pairs 301 and 302 are at the first stopped position, the eccentric cams 402 and 403 abut the positioning members 404 and 405 which are immovably fixed.

Next follows a description of initialization of the diagonal feed mechanism 300 during power-up of the sheet processing apparatus 101, with reference to FIG. 5.

Since the diagonal feed mechanism 300 has no means for detecting the positions of the diagonal feed roller pairs 301 and 302 during power-up of the sheet processing apparatus 101, the initial positions of the diagonal feed roller pairs 301 and 302 are undetermined.

Accordingly, when performing initialization based, for example, on the diagonal feed roller pair 301, the two-shaft motor 401 is always caused to rotate an amount equal to the distance between the point at which the diagonal feed roller pair 301 closes (the first stopped position) and the point at which it opens (the second stopped position). It is necessary to cause the eccentric cam 402 on the side of the diagonal feed roller pair 301 to abut the positioning member 404, place the diagonal feed roller pair 301 at the point at which it closes (the first stopped position), the diagonal feed roller pair 302 at the point at which it opens (the second stopped position), and determine the initial positions of the diagonal feed roller pairs 301 and 302.

Even if the initialization is performed with the diagonal feed roller pair 301 stopped at a position between the first stopped position and the second stopped position, the two-shaft motor 401 will lose synchronization, but by performing this initialization, the eccentric cam 402 will in the end abut the positioning member 404. The initial positions of the diagonal feed roller pairs 301 and 302 can thus be accurately determined.

Once the initial positions of the diagonal feed roller pairs 301 and 302 are determined, the two-shaft motor 401 need only be rotated an amount equal to the distance between the position at which the diagonal feed roller pair 301 closes and the position at which it opens to make it possible to accurately move the diagonal feed roller pairs 301 and 302 to the position at which the rollers open and the position at which they close.

After determining the initial positions of the diagonal feed roller pairs 301 and 302, the positions of the diagonal feed roller pairs 301 and 302 are stored and managed in a RAM 502 (see FIG. 9). Shift-loading is thus possible by controlling the two-shaft motor 401 according to the shift position of the sheet S and making the diagonal feed roller pairs 301 and 302 close and open.

However, as shown in FIG. 6, when powering up the sheet processing apparatus 101, initialization is always needed even if the diagonal feed roller pair 301 is already in the closed position (the first stopped position). That is, the two-shaft motor 401 is caused to rotate an amount equal to the distance between the position at which the diagonal feed roller pair 301 closes (the first stopped position) and the position at which it opens (the second stopped position). Since initialization is performed with the eccentric cam 402 on the side of the diagonal feed roller pair 301 abutting the positioning member 404, the two-shaft motor 401 loses synchronization. Problems therefore arise in that the sound of the motor that has lost synchronization is audible, thus reducing the quietness of the apparatus, and the load on the diagonal feed mechanism 300 reduces its durability.

Accordingly, as shown in FIG. 7, the present embodiment maintains the quietness of the apparatus and the durability of the diagonal feed mechanism 300 by performing stopped position control for always putting the diagonal feed roller pair 301, the reference for the initialization, in the closed position (the second stopped position is more preferable) when the sheet processing apparatus 101 is stopped.

Since the initial positions of the diagonal feed roller pairs 301 and 302 are already determined when operated, rotating the two-shaft motor 401 an amount equal to the distance between the closed position and the open position of the diagonal feed roller pair 301 allows accurate moving of the diagonal feed roller pair 301 to the open position. In other words, it is possible to stop the diagonal feed roller pair 301 at the open position (the second stopped position). By thus preventing the two-shaft motor 401 from losing synchronization during initialization and causing a drop in the quietness of the apparatus and the durability of the diagonal feed mechanism 300 due to the load, the quietness of the apparatus and the durability of the diagonal feed mechanism 300 are ensured.

In other words, referring to FIGS. 8A to 8C, the initialization of the diagonal feed mechanism 300 when powering up the sheet processing apparatus 101 involves controlling the two-shaft motor 401 to move the diagonal feed roller pair 301 from the open position (FIG. 8A) to the closed position (FIG. 8B, by rotating the two-shaft motor 401 by an amount equal to the distance between the closed position and the open position of the diagonal feed roller pair 301, abutting the eccentric cam 402 onto positioning member 404, and thus determining the initial positions of the diagonal feed roller pairs 301 and 302. Thereafter, as shown in FIG. 8C, the two-shaft motor 401 is controlled so as to rotate the diagonal feed roller pair 301 an amount equal to the distance between the closed position and the open position, and stop the diagonal feed roller pair 301 at the open position (the second stopped position).

With this kind of stopped position control, as long as the power is not turned off or an emergency stop is not performed in order to prevent breakage of the apparatus when an error occurs during operation of the sheet processing apparatus 101, the two-shaft motor 401 will not lose synchronization due to the positioning control of the diagonal feed roller pair 301 during the initialization.

The eccentric cam 402 and the eccentric cam 403 are attached to shafts of the two-shaft motor 401 shifting the phase thereof from each other by 180°, as described above. Therefore, when stopping the diagonal feed roller pair 301 at the open position (the second stopped position), the rollers of the diagonal feed roller pair 302 close and stop at the first stopped position. Thus, when initializing the diagonal feed mechanism 300 at power-up time, the diagonal feed roller pair 302 moves to the open position. The diagonal feed roller pair 301 and the diagonal feed roller pair 302 both maintain the quietness of the apparatus by preventing the occurrence of noise due to loss of synchronization by the motor. It is also possible to reduce the load on the diagonal feed mechanism 300 and improve the durability.

It is preferable to make the open position the second stopped position, at which the two-shaft motor 401 has been rotated an amount equal to the distance between the closed position and the open position from the closed position of the diagonal feed roller pair 301, but in terms of preventing occurrence of noise due to the motor losing synchronization, the open position may be a position at which the two-shaft motor 401 has been rotated an amount equal to a more-or-less shorter distance than the distance between the closed position and the open position.

The same effect can be achieved if it is possible to move the diagonal feed roller pair 301 from the stopped position, in other words the open position, to the closed position during power-up, by rotating the two-shaft motor 401 based on the amount of rotation until the rollers are opened from the closed position and stopped. In other words, this is not limited to the second stopped position above. That this applies to the following description as well goes without saying.

Next follows a description of a control system of the sheet processing apparatus 101, which is one example of an embodiment of the present invention, with reference to FIG. 9.

As shown in FIG. 9, the sheet processing apparatus 101 has a CPU circuit portion 500, and the CPU circuit portion 500 contains a CPU (not shown), a ROM 501, and a RAM 502.

The CPU circuit portion 500 provides overall control of a stack tray controller 504, a sheet carrying controller 505, and a diagonal feed mechanism controller 506 using control programs stored in the ROM 501. The RAM 502 temporarily holds control data, and is used as a workspace for performing computations necessary for control.

The CPU circuit portion 500 communicates with the image forming apparatus 102 and the downstream apparatus 103 via an external interface 503, and synchronizes exchange of information and timing when passing sheets among the various apparatuses.

The stack tray controller 504 controls the driving motor M1 based on detection results of the sensor 206 for detecting the top surface of the sheets S sequentially loaded on the stack tray 213, and raises and lowers the stack tray 213 such that the stack tray 213 is always disposed at the sheet receiving position. The stack tray controller 504 controls the driving motor M1 so as to lower the stack tray 213 until the sensor 207 detects the stack tray 213 when removing the sheet S.

The sheet carrying controller 505 controls carrying rollers R and the switching flapper 205. When ejecting the sheet S from the image forming apparatus 102, information regarding the carrying destination of the sheet S is sent to the sheet processing apparatus 101 via the external interface 503.

The sheet carrying controller 505 controls the switching flapper 205 so as to guide the sheet S towards the sheet stacking carrying path 203 when the carrying destination of the sheet S is the sheet processing apparatus 101. The sheet carrying controller 505 controls the switching flapper 204 so as to guide the sheet S towards the ejection carrying path 204 when the carrying destination of the sheet S is the downstream apparatus 103.

Moreover, information other than that regarding the carrying destination of the sheet S such as information regarding the carrying speed of the sheet S or the arrival timing of the sheet S is also sent from the image forming apparatus 102 to the sheet processing apparatus 101 via the external interface 503. The sheet carrying controller 505 controls the carrying rollers R and the switching flapper 205 based on these pieces of information sent from the image forming apparatus 102.

The diagonal feed mechanism controller 506 receives information on the shift direction of the sheet S from the image forming apparatus 102 via the external interface 503. The two-shaft motor 401 is controlled so as to open and close the diagonal feed roller pairs 301 and 302, and diagonally feed the sheet S being carried in the designated shift direction, based on the position information of the diagonal feed mechanism 300 stored in the RAM 502.

A positioning controller 507 and a stopped position controller 508 are connected to the diagonal feed mechanism controller 506. During initialization when the sheet processing apparatus 101 is powered on, the positioning controller 507 controls the two-shaft motor 401 so as to abut the eccentric cam 402 on the side of the diagonal feed roller pair 301 on the positioning member 404, and thereby determines the initial positions of the diagonal feed roller pairs 301 and 302. At the time of the stopping operation of the sheet processing apparatus 101, the stopped position controller 508 controls the two-shaft motor 401 such that the rollers of the diagonal feed roller pair 301 are positioned, without fail, at the second stopped position, which is the reference for the initialization.

Next follows a description of the stopped position control of the diagonal feed mechanism 300, with reference to FIG. 10.

Control is initiated when power is supplied to the sheet processing apparatus 101; completion of positioning control of the diagonal feed roller pair 301 during initialization is waited for in step S101, and once that is complete, the process moves to step S102.

In step S102, the diagonal feed roller pair 301, which is the reference during initialization, is moved to the closed position (the second stopped position), and once the initialization of the diagonal feed roller pairs 301 and 302 during power-up is complete, the process moves to step S103.

In step S103, operation of the sheet processing apparatus 101 is waited for, and once it is started, the process moves to step S105; otherwise, the process moves to step S104.

In step S104, the door 209 where the diagonal feed mechanism 300 is located is checked to determine whether it has been opened/closed. If the door 209 has been opened/closed, there is a possibility that the user accessed the diagonal feed roller pairs 301 and 302 and that they are misaligned, so the process returns to step S101, but if the door 209 has not been opened/closed, the process returns to step S103.

In step S105, cessation of the operation of the sheet processing apparatus 101 is waited for, and once it has stopped, the process moves to step S106.

In step S106, it is determined whether or not the diagonal feed roller pair 301, which is the reference, is at the open position based on the position information of the diagonal feed mechanism 300 stored in the RAM 502. If the diagonal feed roller pair 301 is not in the open position, the process moves to step S102, and the diagonal feed roller pair 301 is moved to the open position (the second stopped position); if it is at the open position, the process returns to step S103.

As described above, with this embodiment, when initializing the roller positions during power-up, the eccentric cam 402 is at a position separated from the positioning member 404, since the diagonal feed roller pair 301 is always stopped at a closed position (the second stopped position).

Accordingly, it is possible to avoid the two-shaft motor 401 from being driven in order to move the diagonal feed roller pair 301 to the first stopped position side with the eccentric cam 402 abutting the positioning member 404.

With this, even if the driving mechanism does not have a sensor for detecting the position of the diagonal feed roller pair 301, it is possible to prevent the two-shaft motor 401 from losing synchronization during initialization of the roller positions at the time of power-up, and the initial positions of the diagonal feed roller pairs 301 and 302 can be determined accurately.

As a result, favorable quietness of the two-shaft motor 401 can be ensured, and durability of the diagonal feed mechanism 300 can be improved.

Moreover, the present invention is not limited to the examples in the above embodiments, and may be appropriately modified within a scope which does not exceed the gist of the present invention.

For example, in the above embodiment, a case was given in which the present invention is applied to the diagonal feed mechanism 300 in the sheet processing apparatus 101, but the present invention may be applied to a driving mechanism in a driving device other than the sheet processing apparatus 101, and need not be limited to the above. Also, while the case was described using the diagonal feed roller pair 301, it is also possible that the diagonal feed roller pair 302 always is stopped at the open position (the second stopped position).

With the present invention, since the movable body is always stopped at a position separated from the first stopped position when initializing the position of the movable body at the time of power-up, an abutting member is at a position separated from the positioning member.

Accordingly, it is possible to avoid driving a driving unit so as to move the movable body towards the first stopped position with the abutting member abutting the positioning member.

This allows accurate determination of an initial position of the movable body by controlling loss of synchronization of a driving unit when initializing a position of a movable body when powering up, even for driving mechanisms which do not have sensors for detecting the position of the movable body.

As a result, favorable quietness of the driving unit can be ensured, and durability of the driving mechanism can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-262718 filed on Sep. 27, 2006 and Japanese Patent Application No. 2007-205406 filed on Aug. 7, 2007 which are hereby incorporated by reference herein in their entirety.

What is claimed is:

1. A sheet conveying device, comprising:

a first roller pair to convey a sheet, the rollers of the first roller pair capable of separating from one another;

a second roller pair to convey the sheet, the rollers of the second roller pair capable of separating from one another, wherein the first roller pair and the second roller pair are collectively disposed in a direction perpendicular to a conveying direction of the sheet;

a first movable-body-abutting-member pair including a first movable body and a first abutting member, to cause the first roller pair to separate or abut, the first abutting member to be abutted by the first movable body;

a second movable-body-abutting-member pair including a second movable body and a second abutting member, to cause the second roller pair to separate or abut, the second abutting member to be abutted by the second movable body;

a driving unit to move the first and second movable bodies; and a control unit to perform control such that an initial position of the first movable body is determined by causing the first movable body to abut the first abutting member using the driving unit when a positioning of the first movable body is started, wherein the first movable body is separated from the first abutting member when the sheet conveying device stops a sheet conveying operation, and wherein the first and second roller pairs form a diagonal feed mechanism to diagonally feed a sheet being conveyed in one or the other of sheet width directions, and each movable-body-abutting-member pair is to move so as to close and open with respect to the sheet with the sheet interposed therebetween.

2. The sheet conveying device claimed in claim 1, wherein the first and second movable bodies are driven by the driving unit, when the first movable body is at a first stopped position, the second movable body is positioned at a second stopped position that is distinct from the first stopped position, and when the first movable body is at the second stopped position, the second movable body is disposed at the first stopped position, and the control unit performs control such that the first movable body is moved to the first stopped position to abut the abutting member using the driving unit during initialization of the positions of the first and second movable bodies at a time when the sheet conveying device powers-up.

3. The sheet conveying device claimed in claim 2, wherein the control unit performs control such that the second movable body is moved to the second stopped position when the sheet conveying device stops a sheet conveying operation.

* * * * *